US005301528A

United States Patent [19]

Hofmann et al.

[11] Patent Number: 5,301,528

[45] Date of Patent: Apr. 12, 1994

[54] DEVICE FOR MANUFACTURING TOOTHED PULLEYS

[75] Inventors: Günter Hofmann, Coburg; Willi Schroth, Obertshausen; Erwin Klein, Rodgau, all of Fed. Rep. of Germany

[73] Assignees: Langstein & Schemann GmbH, Coburg; Herzing & Schroth GmbH & Co., Obertshausen, both of Fed. Rep. of Germany

[21] Appl. No.: 959,827

[22] Filed: Oct. 13, 1992

[51] Int. Cl.[5] ..... B21D 22/16

[52] U.S. Cl. ..... 72/96; 72/108; 29/893.32

[58] Field of Search ..... 72/95, 96, 100, 108, 72/110, 111, 107; 29/893.32

[56] References Cited

U.S. PATENT DOCUMENTS

| | | | |
|---|---|---|---|
| 1,510,889 | 10/1924 | Hooker | 72/85 |
| 1,558,086 | 10/1925 | Gustavsen | 29/893.32 |
| 2,819,632 | 1/1958 | Lyman | 72/107 |
| 2,934,980 | 5/1960 | Grob et al. | 72/95 |
| 3,394,570 | 7/1968 | Erdelyi | 72/107 |
| 3,611,772 | 10/1971 | Haug | 72/107 |
| 3,630,058 | 12/1971 | Kiplinger | 72/96 |
| 3,677,051 | 7/1972 | Schmidt | 72/95 |
| 4,055,977 | 11/1977 | Haswell | 72/110 |
| 4,083,215 | 4/1978 | Guetzlaff | 72/96 |

FOREIGN PATENT DOCUMENTS

| | | | |
|---|---|---|---|
| 4089151 | 3/1992 | Japan | 72/108 |
| 1639859 | 4/1991 | U.S.S.R. | 72/108 |

*Primary Examiner*—Lowell A. Larson
*Assistant Examiner*—Michael J. McKeon
*Attorney, Agent, or Firm*—Anderson Kill Olick & Oshinsky

[57] ABSTRACT

A device for non-cutting manufacturing of an annular part having external teeth includes a core tool that supports the blank from which the annular part is manufactured and is axially displaceable between two profiling rollers arranged diametrically opposite each other, and a separate rotating drive for each of the core tool and the two profiled rollers. The device further includes a computer element which controls the three rotating drives for synchronizing rotational speeds of the core tool and the two profiling rollers. The computer element also controls radial adjustment of the two rollers with their respective full-height regions with respect to the core tool by a calibration amount at the conclusion of the shaping operation.

3 Claims, 2 Drawing Sheets

DEVICE FOR MANUFACTURING TOOTHED PULLEYS

BACKGROUND OF THE INVENTION

The invention is directed to a device for non-cutting manufacture of an annular part having external teeth, particularly a toothed pulley, from a pot-shaped blank in which a core tool carrying the blank and having external teeth is rotatable by means of a drive, in which a profiling roller with external teeth arranged parallel to the axis is rotatable by means of a drive, in which the core tool and the profiling roller are rotatable synchronously at the same circumferential speed by means of a synchronizing device, and in which the profiling roller has a stopping bevel at its circumference, in the vicinity of one end face, having a tooth height which increases gradually up to a full-height tooth region, and the core tool with the blank and the profiling roller are movable in the axial direction relative to one another during the shaping, wherein the profiling roller is substantially immobile in the radial direction relative to the core tool during the shaping and for the purpose of shaping.

In a known device of this type (U.S. Pat. No. 1,510,889) only one profiling roller is provided which is supported in the radial direction so as to be stationary relative to the core tool. A rotary drive is provided jointly for the profiling roller and the core tool and a toothed gear unit is provided as synchronizing device. For the purpose of shaping, the profiling roller is moved axially, the core tool being fixed in the axial direction. The toothed annular part produced by means of this device has a certain amount of taper in the axial direction and is not usable when high demands are made on the cylindrical shape of the ring or on the parallelism of the teeth.

Another device is known (DE-PS 37 11 927) in which two profiling rollers are rotatably driven in the same direction and in a synchronous manner, are arranged diametrically relative to one another with reference to a core tool, and are supported so as to be adjustable relative to the core tool. Each profiling roller as well as the core tool is associated with its own rotary drive and a computer control for the three rotary drives is provided as synchronizing device. The profiling rollers and the core tool are not adjusted relative to one another in the axial or radial directions for the shaping. The radial adjustability serves for adjusting the constant distance of the profiling rollers relative to the core tool during the shaping. This device permits non-cutting manufacture of annular parts having external teeth, e.g. toothed pulleys, with a high profiling precision and an exact cylindrical shape of the finished annular part.

SUMMARY OF THE INVENTION

An object of the invention is to provide a device of the type indicated in the beginning by which toothed annular parts can be manufactured with increased profile precision and improved cylindrical shape regardless of the axial movement during the shaping and regardless of the stopping bevel of the toothing of the profiling roller. This object is met by the device according to the invention which is characterized in that at least two identical profiling rollers are provided which are driven so as to rotate in the same direction and synchronously and are supported so as to be adjustable radially relative to the core tool, in that each profiling roller as well as the core tool is assigned its own rotary drive and the synchronizing device is a computer control of the three rotary drives, in that the core tool is moved axially when the profiling rollers are stationary in the axial direction for the purpose of shaping, and in that the two profiling rollers with the full-height tooth regions are adjusted in the radial direction relative to the core tool by a calibration amount via the computer control at the conclusion of the shaping.

It is decisive for the improved profile precision and cylindrical shape of the toothed annular parts produced by the device according to the invention that the two profiling rollers with the full-height tooth regions are adjusted in the radial direction relative to the core tool by a calibration amount via the computer control at the conclusion of the shaping. This is achieved in a simple manner with respect to the device in that the synchronization of the rotating movements by means of computer-controlled, separate rotary drives and the axial movement of the core tool are provided in combination. The profiling rollers are substantially immobile radially during the shaping and for the purpose of shaping, i.e. they are not moved radially by the amount of the profile depth. Rather, the profiling rollers are adjusted radially only by the calibrating amount.

During the shaping, the pot-shaped blank moves past between the two profiling rollers which are arranged in a plane at a distance from another so as to be parallel to the axis and obtains its toothing at the outer surface area or annular part. The shaping process is continuous and begins at the stopping bevel of the profiling rollers and is concluded when the annular part having the external teeth, e.g. the toothed pulley, moves out of the space between the two profiling rollers. The calibration is the end phase of shaping. The non-cutting manufacture of toothed pulleys in the described manner is simple and not problematic, results in an exact fit of the tooth profiles within close tolerances and also involves a comparatively small expenditure of energy and time.

It is particularly advisable and advantageous when two profiling rollers are arranged diametrically relative to one another with reference to the core tool. This results in a simplified and nevertheless operationally reliable device.

BRIEF DESCRIPTION OF THE DRAWINGS

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
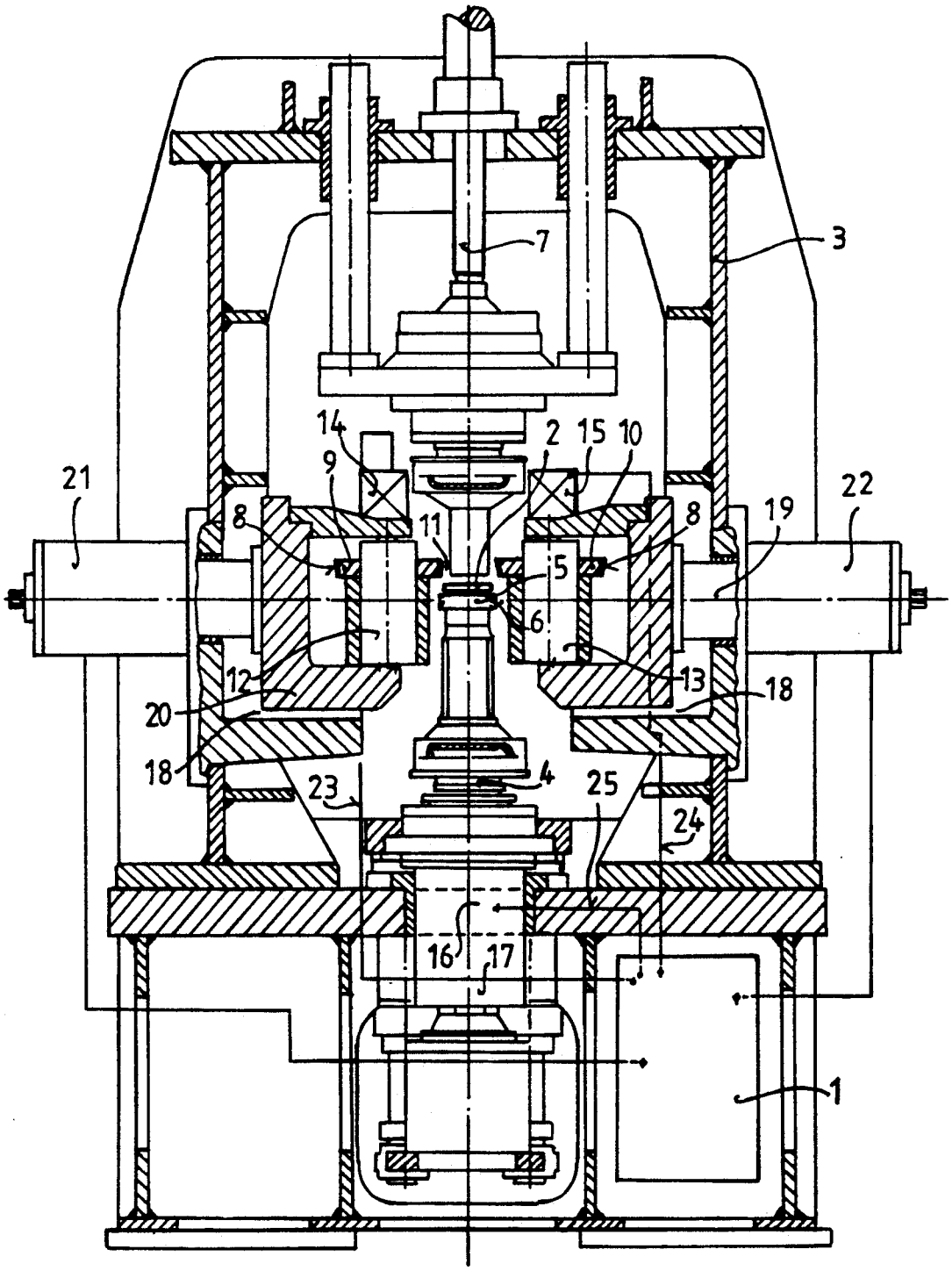
FIG. 1 shows a schematic cross-sectional side view of a device for manufacturing of tooth pulleys according to the invention.

The device according to the drawing is used for non-cutting manufacture of annular parts having external teeth, e.g., of toothed pulleys, from a pot-shaped blank 2 by means of continuous shaping, wherein the pot-shaped blank 2 rotates continuously during the shaping and is simultaneously moved in the axial direction relative to the profiling tools. The device comprises a driven main spindle 4 which is supported in a machine frame 3 and has a core tool 5 or receiving mandrel at its free end, which carries the pot-shaped pre-formed blank 2. The core tool has external teeth 6. Further, an axially displaceable clamping or secondary spindle 7, which holds the blank 2 on the core tool 5 during the shaping, is associated with the core tool 5.

Further, two identical profiling rollers 9, 10 having corresponding external teeth 8 are rotatably supported in the machine part 3. These two profiling rollers 9, 10 are located in a common plane and at a distance from one another so that there is a space 11 between them. The gap width between the external teeth 8 of the two profiling rollers 9, 10 and the core tool 5 corresponds to the shape of the toothing of the annular part to be manufactured.

The two profiling rollers 9, 10 are supported by means of shafts 12, 13 which are supported in carriages and acted upon by rotary drives 14, 15 actuated by an electric motor arranged on one of the carriages. A hydraulic cylinder device 17 is used for the axial displacement of the main spindle 4 with the core tool 5 and the blank 2. A rotary drive 16 of the core tool 5 is also provided in the device 17. The two shafts 12, 13 with their rotary drives 14, 15 and the profiling rollers 9, 10 are arranged diametrically relative to one another with reference to the main spindle 4.

The two profiling rollers 9, 10 with their shafts 12, 13 and their rotary drives 14, 15 are supported in the machine frame 3 so as to be adjustable radially relative to the main spindle 4. The machine frame 3 has a guide 18 on each side for the carriages 19, 20 which carry the shafts 12, 13 with the profiling rollers 9, 10 between a lower bearing and an upper bearing. Hydraulic drives are arranged in the machine frame 3 as fixing deices 21, 22 for the carriages 19, 20.

Figure 2:
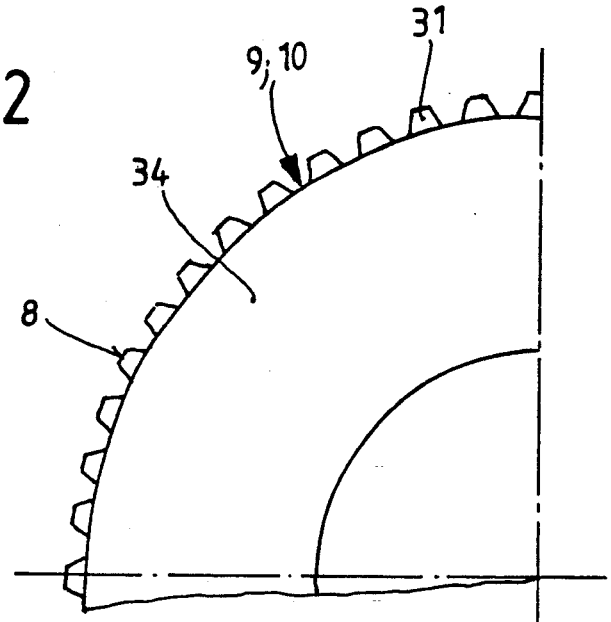
FIG. 2 shows an end view of a portion of an end face of a profiling roller of the device according to FIG. 1 in enlarged scale relative to FIG. 1.
Figure 3:
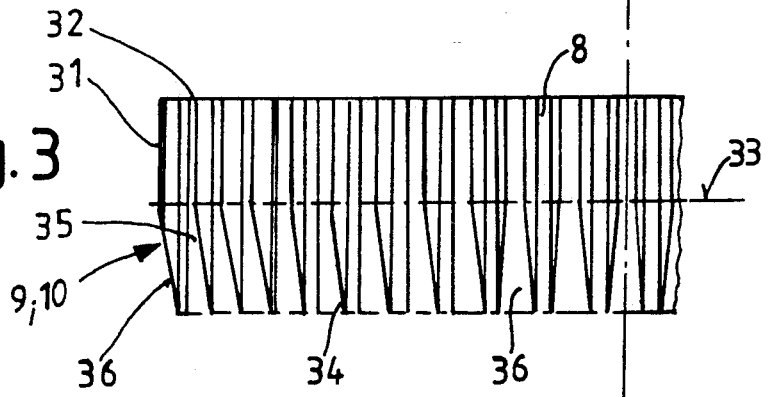
FIG. 3 shows a partial side view of the profiling roller according to FIG. 2.
Figure 4:
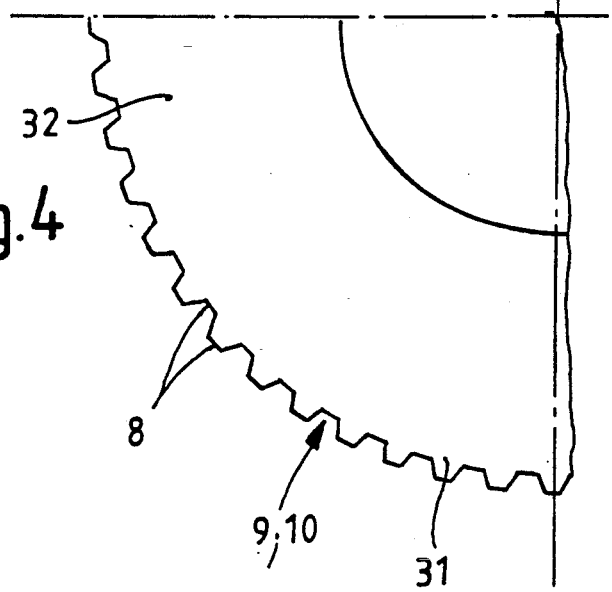
FIG. 4 shows an end view of a portion of the other end face of the profiling roller according to FIG. 2.

The two profiling rollers 9, 10 have an external toothing 8 with teeth according to FIGS. 2 to 4, the height of the teeth being fully formed in a full-height tooth area 31, i.e., in the area of one end face 32 of the profiling roller 9, 10 extending to a radial plane 33, while the tooth height from the center radial plane 33 of the profiling rollers 9, 10 to the other end face 34 of the latter drops to zero. The teeth 35, which gradually increase from the end face 34 to the radial plane 33, form a stopping bevel 36 which undulates in a tooth-shaped manner in the circumferential direction, is conical int he axial direction, and has a continuous transition from one end face 34 tot he full-height teeth 31 beyond the radial plane 33.

Due to the gradually increasing tooth height of the teeth 35, a continuous shaping of the blank 2 is effected when the core tool 5 with the blank 2 and the profiling rollers 9, 10 rotate jointly as well as move relative to one another in the axial direction. The tooth profile of the annular part or toothed pulley to be manufactured is complete in the region of the radial plane 33 so that the full-height teeth finally only calibrate the tooth profile of the annular part. Due to the synchronization between the profiling rollers 9, 10 and the blank 2, it is also possible to manufacture externally tooth annular parts having one or more toothed spaces.

The device includes a computer control 1 from which the control lines 23, 24, 25 extend to the three rotary drives 14, 15, 16 and control lines 26, 27 extend to the two adjusting deices 21, 22. The computer control 1 is provided with all the conventional devices necessary to achieve the accurate synchronous running of the profiling rollers 9, 10 and the core tool 5 and to achieve the calibrating amount adjusting movement of the two profiling rollers 9, 10 toward the end of the shaping process.

While the invention has been illustrated and described as embodied in a device for manufacturing toothed pulleys, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A device for the non-cutting manufacturing of an annular pot-shaped part, having external teeth, from a pot-shaped blank, having internal teeth, said device comprising:

a core tool for supporting the pot-shaped blank and having an axis and external teeth for engaging the internal teeth of the pot-shaped blank to accurately position the pot-shaped blank on said core tool;

at least two identical profiling rollers arranged on opposite sides of said core tool diametrically opposite each other for rotation about axes extending parallel to the axis of said core tool, wherein each of said at least two profiling rollers has, on a circumference thereof, a runoff bevel with a tooth height increasing to a full-height tooth region;

a first drive means for rotating said core tool;

a second drive means for rotating said at least two profiling rollers;

a means for axially displacing said core tool;

a means for radially displacing said at least two profiling rollers toward said core tool; and a computer means for controlling said first and said second drive means so that said first and said second drive means rotate said core tool and said at least two profiling rollers, respectively, with synchronized rotational speeds, for controlling said axially displacing means so that said axially displacing means displaces said core tool axially relative to said at least two profiling rollers during the main portion of the shaping operation, when said at least two profiling rollers remain radially stationary, and for controlling said radially displacing means so that said radially displacing means advances said at least tow profiling rollers toward said core tool by a calibration amount at the conclusion of the shaping operation when said core tool remains axially stationary so as to bring said full-height tooth regions of said at least two profiling rollers into engagement with a tooth profile which has already been formed on the pot-shaped blank, for calibrating the tooth profile.

2. The device of claim 1, wherein said runoff bevel and said full-height region have an equal axial length.

3. The device of claim 2, wherein said second drive means and said radially displacing means each comprises separate drives for each f said at least two profiling rollers.

* * * * *

UNITED STATES PATENT AND TRADEMARK OFFICE

CERTIFICATE OF CORRECTION

PATENT NO. : 5,301,528

DATED : April 12, 1994

INVENTOR(S) : Gunter Hofman et al

It is certified that error appears in the above-indentified patent and that said Letters Patent is hereby corrected as shown below:

On the title page: Item [73] Assignee's

Langenstein & Schemann GmbH, Coburg; Herzing & Schroth GmbH & Co., Obertshausen, both of Fed. Rep. of Germany Signed and Sealed this Twenty-fifth Day of April, 1995

*Attest:*

BRUCE LEHMAN

*Attesting Officer*

*Commissioner of Patents and Trademarks*